US012403557B2

(12) United States Patent
Piraube et al.

(10) Patent No.: US 12,403,557 B2
(45) Date of Patent: Sep. 2, 2025

(54) METHOD OF OPTIMIZING A SUPPORT MATERIAL FOR AN OPERATION OF SURFACING OF A LENS BLANK

(71) Applicant: Essilor International, Charenton-le-Pont (FR)

(72) Inventors: Sébastien Piraube, Dallas, TX (US); Xavier Bultez, Charenton-le-Pont (FR); Jérome Moine, Charenton-le-Pont (FR)

(73) Assignee: Essilor International, Charenton-le-Pont (FR)

( * ) Notice: Subject to any disclaimer, the term of this patent is extended or adjusted under 35 U.S.C. 154(b) by 1422 days.

(21) Appl. No.: 16/755,059

(22) PCT Filed: Oct. 8, 2018

(86) PCT No.: PCT/EP2018/077274
§ 371 (c)(1),
(2) Date: Apr. 9, 2020

(87) PCT Pub. No.: WO2019/072744
PCT Pub. Date: Apr. 18, 2019

(65) Prior Publication Data

US 2021/0187690 A1 Jun. 24, 2021

(30) Foreign Application Priority Data

Oct. 13, 2017 (EP) ..... 17306388

(51) Int. Cl.
*B24B 13/005* (2006.01)
*B24B 9/14* (2006.01)

(52) U.S. Cl.
CPC ..... *B24B 13/0055* (2013.01); *B24B 9/146* (2013.01)

(58) Field of Classification Search
CPC .. B24B 5/02; B24B 5/04; B24B 5/047; B24B 5/06; B24B 5/12; B24B 7/245;
(Continued)

(56) References Cited

U.S. PATENT DOCUMENTS 7,086,928 B2 * 8/2006 Siders ..... B24B 9/146 451/5
2016/0114453 A1 * 4/2016 Godot ..... B29D 11/00942 29/407.04

FOREIGN PATENT DOCUMENTS

WO 2015/000758 A1 1/2015

OTHER PUBLICATIONS

International Search Report, dated Nov. 9, 2018, from corresponding PCT application No. PCT/EP2018/077274.

* cited by examiner

*Primary Examiner* — Brian D Keller
*Assistant Examiner* — Jason Khalil Hawkins
(74) *Attorney, Agent, or Firm* — NIXON & VANDERHYE

(57) ABSTRACT

In a method of preparing a lens blank for a surfacing operation, the lens blank is fastened to a support with a base and a support material via which the lens blank is fastened. The support material has a circular periphery. The surfacing transforms the lens blank into a surfaced lens. The method includes: determining the surfaced lens shape based on input data; based on the surfaced lens shape, determining a maximum diameter of the support material shape based on a predetermined maximum thickness defining the maximum thickness of the support material allowed to be cut into during the surfacing of the lens blank; choosing a diameter for the support material shape ≤the maximum diameter for further fastening the lens blank to the support by forming the
(Continued)

support material so the support material shape has a diameter corresponding to the chosen diameter.

16 Claims, 5 Drawing Sheets

(58) Field of Classification Search
CPC .. B24B 9/14; B24B 9/146; B24B 9/10; B24B 9/20; B24B 13/005; B24B 13/057; B24B 13/02; B24B 13/023; B24B 13/26; B24B 13/0025; B24B 13/06; B24B 13/065; B24B 13/043; B24B 41/06–068; B24B 49/02; B24B 49/03; B24B 49/05
USPC ..... 451/82, 255, 256, 277, 323, 325, 384, 451/921
See application file for complete search history.

METHOD OF OPTIMIZING A SUPPORT MATERIAL FOR AN OPERATION OF SURFACING OF A LENS BLANK

BACKGROUND OF THE INVENTION

Field of the Invention

The invention relates to the field of industrial surfacing processes to manufacture ophthalmic lenses.

The invention relates more particularly to a method of optimizing a support material in order to prepare an operation of surfacing of a lens blank.

Description of the Related Art

In general, a spectacle lens is specifically manufactured according to every wearer's needs which may take the form of specifications defined in a prescription established by an ophthalmologist.

For the manufacturing of a lens, a lens blank is submitted to various steps to form the desired lens, in particular one of surfacing during which the shape of the lens blank is modified to convey to the resulting shape, or surfaced lens shape hereafter, desired optical properties. In practice, such as an operation is often carried out on a semi-finished lens blank whose front surface has previously been treated, the operation of surfacing essentially impacting the back surface in accordance with the prescription. Another one of these steps which is carried out prior to the surfacing step is a blocking step in which the semi-finished lens blank is fastened to a support which includes a support base and a support material via which the lens blank is fastened to the support base. The support material is arranged to define a support material shape having a circular periphery. The support material is typically formed from an alloy, while the support base is formed from a metallic material. The support allows easier handling of the lens blank without damaging it during the further operations carried out on the lens blank. Following steps include a polishing step and an engraving step. A de-blocking step enables then to detach the lens from the support.

With a view of fastening the lens blank to the support, different devices and tools may be used. For instance, a blocking ring may be used during the blocking step. Moreover, a prismatic blocker may be used as a complement to the blocking ring to fasten the lens blank to the support with a given tilt angle in order to respect specifications of the prescription like, for instance, prism.

Other techniques are known to fasten the lens blank to the support via the support material.

Yet, all share a similar problem in that a large amount of support material is cut during the surfacing step and represents a substantial loss.

The invention seeks to improve this situation.

SUMMARY OF THE INVENTION

The present invention advantageously provides a method of preparing a lens blank for a further operation of surfacing of said lens blank wherein the lens blank is fastened to a support which includes a support base and a support material via which the lens blank is fastened to the support base, the support material being arranged to define a support material shape having a circular periphery, the operation of surfacing being configured to transform the lens blank into a surfaced lens having a surfaced lens shape at the end thereof, the method being implemented using a processing module and comprising:

- determining the surfaced lens shape based on input data,
- based on the surfaced lens shape, determining a maximum diameter of said support material shape as a function of a predetermined maximum thickness defining the maximum thickness of the support material which is allowed to be cut into during the surfacing of the lens blank, and
- choosing a diameter for the support material shape inferior or equal to said maximum diameter for further fastening of the lens blank to the support by forming the support material so that the support material shape has a diameter corresponding to the chosen diameter.

According to a feature, the minimal distance from the center of the support material at which the thickness of the surfaced lens shape equals the opposite of the maximum thickness is determined. The minimal distance defines a support material cut-related maximum radius of the support material shape based on which the maximum diameter of the support material shape is determined, the thickness of the surfaced lens being counted negatively beyond the edge of the surfaced lens shape when the thickness of the surfaced lens shape decreases toward the edge of said surfaced lens shape.

According to another feature, the maximum diameter of the support material shape is also determined as a function of an overhang-related maximum radius. The overhang corresponds to the radial distance between the edge of the surfaced lens shape and that of the support material. The overhang-related maximum radius is determined based on the maximum radius of the surfaced lens shape on the one hand, and, on the other hand, a predetermined minimum overhang and a support material tolerance margin related to a precision with which the support material is formed.

According to another feature, the maximum diameter is chosen as the minimum between the overhang-related maximum radius and the support material cut-related maximum radius.

According to another feature, the method further comprises determining a minimum diameter of the support material shape. The diameter for the support material shape is chosen equal or greater than the minimum diameter.

According to another feature, the minimum diameter is determined as a function of an overhang-related minimum radius. The support overhang corresponds to the radial distance between the edge of the surfaced lens shape and that of the support material.

According to another feature, the overhang-related minimum radius is determined as a function of the maximum radius of the surfaced lens shape and a predetermined maximum overhang which is chosen as a function of the material of the lens blank.

According to another feature, the minimum diameter is determined as a function of an overhang-related absolute minimum radius defined as a function of the maximum radius of the surfaced lens shape and a predetermined absolute maximum overhang chosen for the surfacing of the lens blank independently from the material of the lens blank.

According to another feature, the minimum diameter is determined as a function of a minimum lens thickness-related radius determined based on a chosen minimum thickness of the surfaced lens shape.

According to another feature, the minimum lens thickness-related radius is determined as the radius of the region of the lens outside of which the thickness of the surfaced lens shape is above the chosen minimum thickness.

According to another feature, the minimum diameter of the support material shape is determined as corresponding to the minimum between the overhang-related minimum radius on the one hand, and, on the other hand, the maximum of the overhang-related absolute minimum radius and the minimum lens thickness-related radius.

According to another feature, choosing the diameter of the support material shape is carried out based on configuration data representative at least of predetermined preference settings for the operation of surfacing.

The invention also relates to a computer program comprising instructions destined to be executed by a processor for the implementation of the method.

The invention further relates to an apparatus for preparing a lens blank for a further operation of surfacing of said lens blank wherein the lens blank is fastened to a support which includes a support base and a support material via which the lens blank is fastened to the support base, the support material being arranged to define a support material shape having a circular periphery, the operation of surfacing being configured to transform the lens blank into a surfaced lens having a surfaced lens shape at the end thereof, the apparatus comprising:

- a human-machine interface for receiving input data, and
- a processing module configured to:
  - determine the surfaced lens shape based on input data,
  - based on the surfaced lens shape, determine a maximum diameter of said support material shape as a function of a predetermined maximum thickness defining the maximum thickness of the support material which is allowed to be cut into during the surfacing of the lens blank, and
  - choose a diameter for the support material shape of the support material inferior or equal to said maximum diameter for further fastening of the lens blank to the support by forming the support material so that the support material shape has a diameter corresponding to the chosen diameter.

BRIEF DESCRIPTION OF THE DRAWINGS

Other features and advantages of the invention will become apparent from the following description provided for indicative and non-limiting purposes, with reference to the accompanying drawings, wherein.

DESCRIPTION OF THE PREFERRED EMBODIMENTS

Figure 1:
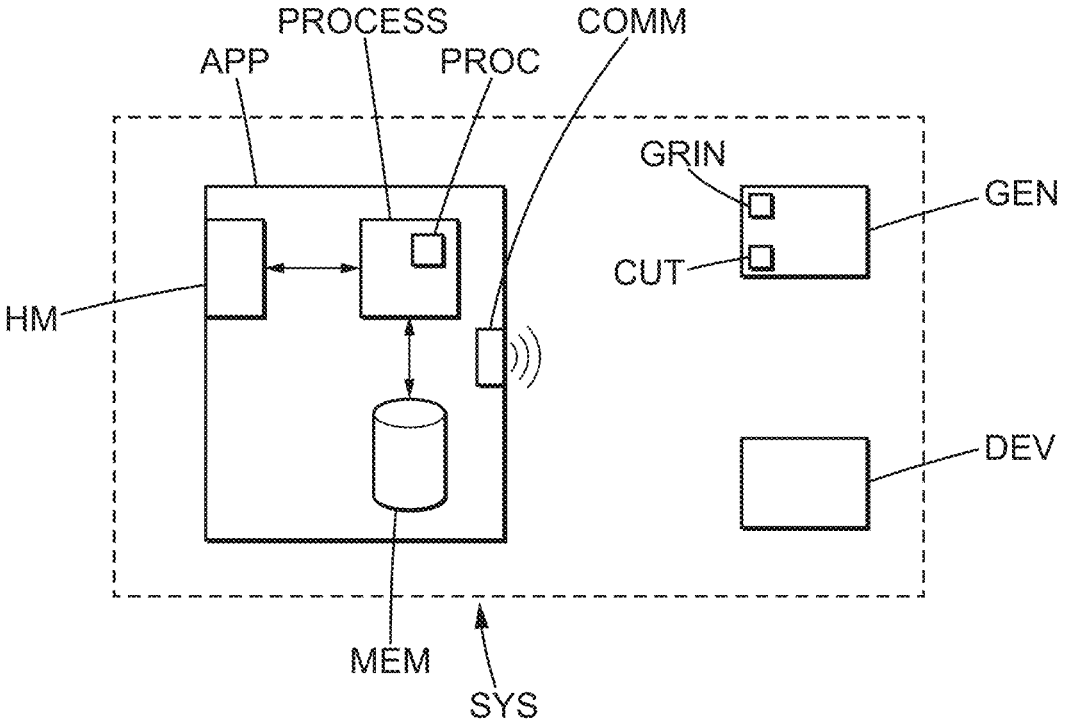
FIG. 1 illustrates a system according to the invention.

FIG. 1 illustrates a system SYS according to the invention. The system SYS comprises a plurality of devices configured to be used during the operation of surfacing of a lens blank BLA, and an apparatus APP according to the invention.

Each of the devices of the plurality of devices is configured to be used during one or more step of the operation of surfacing, such as a step of blocking and/or of the surfacing of the lens blank BLA per se.

The plurality of devices comprises at least a device DEV and a generator GEN.

In reference to FIG. 2, the device DEV is configured to be used during the blocking step to allow the lens blank BLA to be fastened to a support SUPP detailed below.

Figure 2:
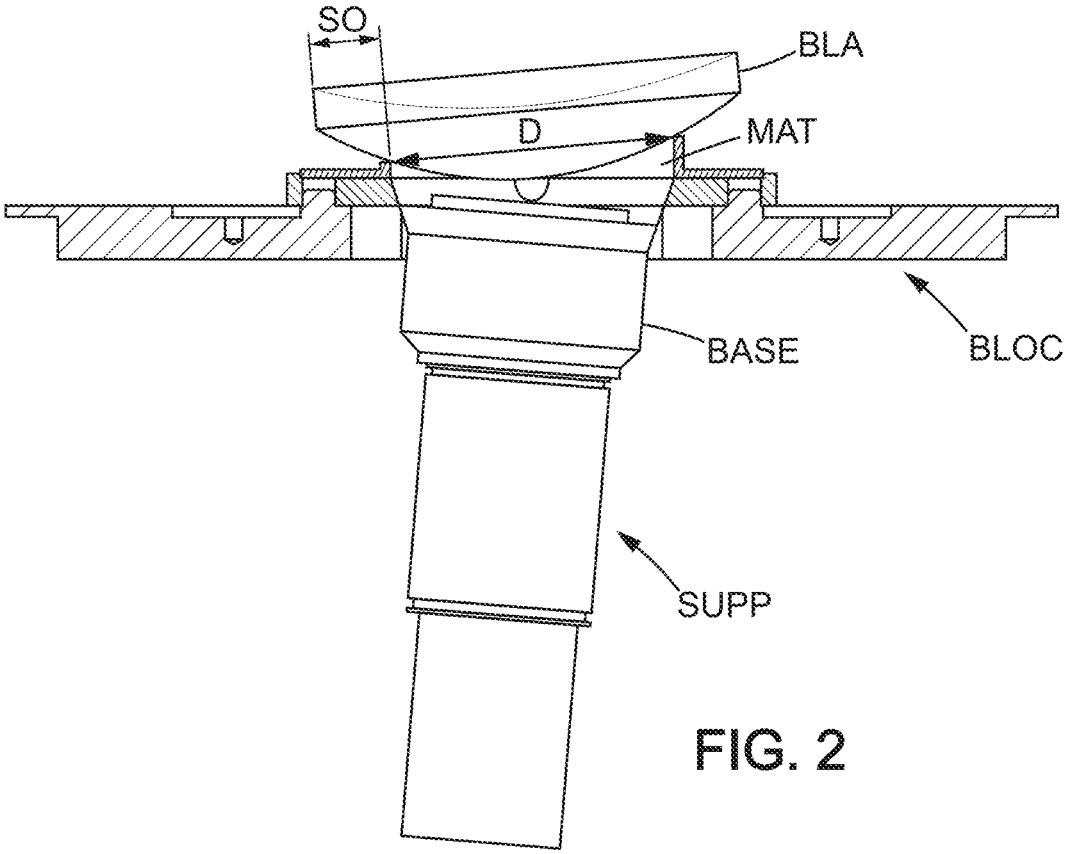
FIG. 2 illustrates a lens blank, a blocking ring and a part of a prismatic blocker.

This FIG. 2 illustrates the device DEV and the lens blank BLA during the blocking step in which the lens blank BLA is fastened to the support SUPP by means of the device DEV.

The blocking step carried out by the device DEV precedes the surfacing step per se during which the lens blank BLA is transformed into a surfaced lens SLE to respect a prescription. Typically, such a prescription is established by an ophthalmologist.

The lens blank BLA comprises a front surface and a back surface. To minimize delays in the delivery of the surfaced lens SLE, one of the front and back surfaces is already finished before the operation of surfacing (hence the term "semi-finished"). In general, the front surface is the finished surface and the back surface is treated to respect the prescription. Alternatively, the back surface may be finished and the front surface is treated to respect the prescription.

The treatment of the unfinished surface of the lens blank includes the operation of surfacing.

In a general sense, the operation of surfacing can be seen as including the blocking step, during which the lens blank BLA is fastened to the support SUPP as detailed below, and the surfacing of the lens blank BLA per se after the lens blank BLA has been attached to the support SUPP.

The support SUPP is adapted to be fastened to the lens blank BLA during the blocking step. The support SUPP makes it easier to handle the lens blank BLA during the following operations, like the operation of surfacing, without damaging the lens blank BLA. More precisely, the support SUPP is fastened to the surface of the lens blank BLA that is already finished, typically the front surface. The other surface, hence the back surface, is thus left free for the operation of surfacing per se.

The support SUPP comprises a support base BASE and a support material MAT via which the lens blank BLA is fastened to the support base BASE. Typically, such a support base BASE is formed from a metallic material, while the support material MAT is formed from an alloy. Alternatively, the support base BASE is formed from a plastic material, while the support material MAT is formed from an adhesive. In the following description, the support material MAT is formed from an alloy.

The support material MAT is arranged to define a support material shape having a circular periphery characterized by a diameter D. In other words, the support material MAT fills a volume which exhibits this support material shape.

Regarding the device DEV, it may be a blocking ring RING, a prismatic blocker BLOC or a combination of both.

The blocking ring RING is configured to define internally the volume to be filled by the support material MAT via which the lens blank BLA is fastened to the support base BASE. In particular, it is adapted to define the geometric configuration of the support material MAT and the diameter D of the circular periphery of the support material MAT.

The prismatic blocker BLOC, only a part of which is illustrated here, comprises a body in which a cavity is arranged. The cavity enables to provide the support SUPP to which the lens blank BLA is fastened.

As for the generator GEN, the latter is configured to shape the lens blank BLA into the surfaced lens SLE during the operation of surfacing.

For example and in reference to FIG. 1, the generator GEN includes a grinding module GRIN and/or a cutting module CUT which each configured to remove some of the matter of the lens blank BLA to shape the lens blank BLA into the surfaced lens SLE.

In addition, the generator GEN may include a body in which a cavity is arranged. The cavity is disposed and designed to receive the lens blank BLA for the operation of surfacing. In particular, the lens blank BLA is maintained in the cavity via the support SUPP which is then at least partly located in the cavity. For instance, the lens blank BLA is fixed relative to the body of the generator and relative to which one or more piece of equipment of the grinding module GRIN and/or the cutting module CUT is movable. Alternatively, the lens blank BLA is configured to move relative to the body of the generator, but to a same sought effect.

As for them, the grinding module GRIN and the cutting module CUT are adapted to process the lens blank BLA during the operation of surfacing to respect the prescription.

Regarding the apparatus APP, the latter is configured to prepare the operation of surfacing of the lens blank BLA to transform the lens blank BLA into a surfaced lens SLE. In particular, it is configured to determine the diameter D of the support material MAT to which the lens blank BLA is fastened during the blocking step.

As illustrated in FIG. 1, the apparatus APP comprises a human-machine interface HM, a communication module COMM, a memory MEM and a processing module PROCESS.

The human-machine interface HM is adapted for an operator to interact with the apparatus APP, advantageously for inputting data which specify the modalities of the operation of surfacing.

Advantageously, the data comprise input data which include specifications of the prescription and specifications regarding the support material MAT. The specifications of the prescription include for instance base, prism compensation (representative of a manufacturing deviation and a blocking error), data representative of a decentration and a thinning of the surfaced lens SLE. These data enable for instance to define the shape of the surfaced lens SLE.

Advantageously, the data comprise configuration data, which include a predetermined minimum overhang MinOv and a predetermined maximum overhang MaxOv. The overhang is the distance between the edge of the surfaced lens SLE obtained after the operation of surfacing and the edge of the circular periphery of the support material MAT.

The configuration data may also comprise a predetermined absolute maximum overhang AbsMaxOv. The predetermined absolute maximum overhang AbsMaxOv is defined as the maximum distance between the edge of the surfaced lens SLE and the edge of the circular periphery of the support material MAT chosen for the surfacing of the lens blank independently from the material of the lens blank BLA. The distinction between the predetermined maximum overhang MaxOv and the predetermined absolute maximum overhang AbsMaxOv is that, typically, the predetermined maximum overhang MaxOv is variable and is, for instance, set by the operator configuring the apparatus APP. Conversely, the predetermined absolute maximum overhang AbsMaxOv is typically not variable and can be seen as a limit preventing a misuse of the apparatus APP by the operator. Advantageously, the predetermined absolute maximum overhang AbsMaxOv is already configured in the apparatus APP and is thus not a data inputted by the operator.

The configuration data may also include a support material tolerance margin Marg. The support material tolerance margin Marg is a safety distance between the edge of the surfaced lens and the edge of the circular periphery of the support material MAT.

Furthermore, the configuration data also comprise a maximum thickness MaxTh of the support material MAT which is allowed to be cut into during the operation of surfacing and a minimum thickness MinTh of the lens which does not need any support SUPP during the operation of surfacing.

In other words, the maximum thickness MaxTh is the greatest thickness of the support material MAT which can be cut during the operation of surfacing of the lens blank BLA. As for the minimum thickness MinTh, the latter corresponds to the lowest thickness of the lens which does not need any support SUPP during the operation of surfacing.

It should be noted that the configuration data have been described as being inputted through the Human-Machine Interface HM.

However, these data may be received by the apparatus APP by any other means, such as through the communication module COMM.

Advantageously, the human-machine interface HM includes a display.

The display is adapted for displaying information, such as that which pertain to the surfacing of the lens blank or the preparation thereof. For instance, it is adapted to display the diameter D of the circular periphery of the support material MAT.

As for the communication module COMM, the latter is configured to allow the apparatus APP to communicate with other devices. For instance, it is adapted to allow the apparatus APP to communicate with the device DEV and the generator GEN.

For instance, the module in question is adapted to transmit a signal representative of the diameter D. This signal may be sent to any device.

In a general manner, any cable and/or non-cable communication technology may be supported by the communication module COMM.

The memory MEM is adapted to store various programs which may be required for the apparatus APP to operate. In particular, in the context of the invention, the memory MEM is configured to store a computer program which includes instructions whose execution by a processor PROC, such as one comprised by the processing module PROCESS, causes the method according to the invention described below to be implemented.

The method is detailed hereinafter in reference to FIG. 3.

Figure 3:
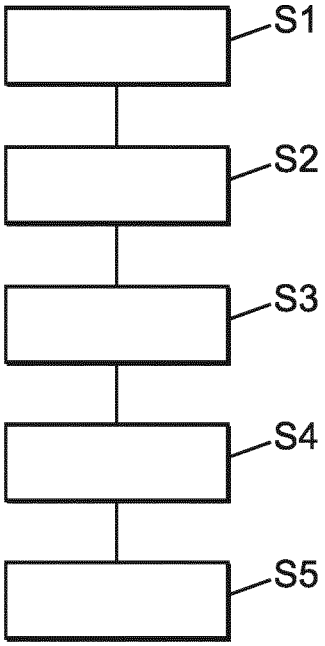
FIG. 3 illustrates schematically a method of preparing an operation of surfacing of a lens blank according to the invention.

FIG. 3 schematically illustrates the method of preparing the operation of surfacing of the lens blank BLA according to the invention.

In a first step S1, the input data are provided to the apparatus APP. The input data are for example inputted via the human-machine interface HM. Alternatively, they are provided using the communication module COMM. The shape of the surfaced lens SLE is determined from the input data.

In a second step S2 which forms a core step in the sense of the invention, the configuration data are provided to the apparatus APP. The configuration data are for example inputted via the human-machine interface HM. Alternatively, they are provided using the communication module COMM. Advantageously, the configuration data are inputted with the input data in the first step S1.

More importantly, during this step, a maximum diameter DMAX of the support material MAT is determined.

The details of the second step S2 of the method will be described hereinafter in reference to FIG. 4.

In a third step S3, a minimum diameter $D_{MIN}$ of the support material MAT is determined. The details of the third step S3 of the method will be described hereinafter in reference to FIG. 7.

In a fourth step S4, the diameter D of the circular periphery of the support material MAT is chosen between the minimum diameter $D_{MIN}$ and the maximum diameter $D_{MAX}$. In a given embodiment, the choice of minimizing or maximizing the diameter D of the support material MAT forms part of the configuration data. For instance, the diameter D chosen is the minimum diameter $D_{MIN}$. Alternatively, the diameter D chosen is the maximum diameter $D_{MAX}$.

The results of the method are for example displayed on the human-machine interface HM and are thus made available to the operator. Alternatively or in parallel, the results are transmitted to a further device configured to control at least one device of the plurality of devices for the operation of surfacing of the lens blank BLA.

In a fifth step S5, the operation of surfacing is carried out on the lens blank BLA to transform the lens blank BLA in the surfaced lens SLE according to the results obtained in the previous steps. The surfaced lens SLE obtained after surfacing complies with the prescription.

Figure 4:
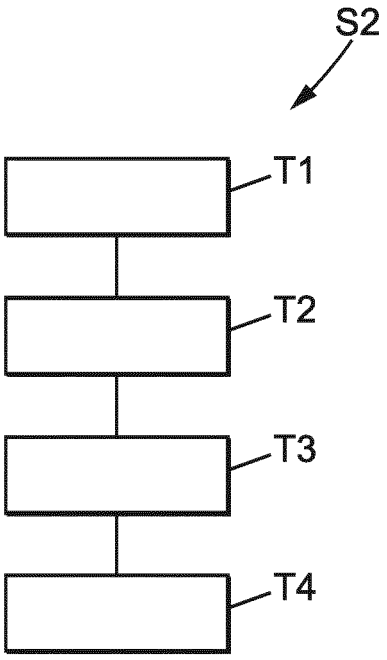
FIG. 4 illustrates schematically a method of determining a maximum diameter of a support material shape.

As for the details of step S2, FIG. 4 illustrates schematically a method of determining the maximum diameter $D_{MAX}$ of the support material shape.

A first step T1 will be described in reference to the FIGS. 5A and 5B. It is determined, on the basis of the shape of the surfaced lens SLE determined in the step S1.

Figure 5A:
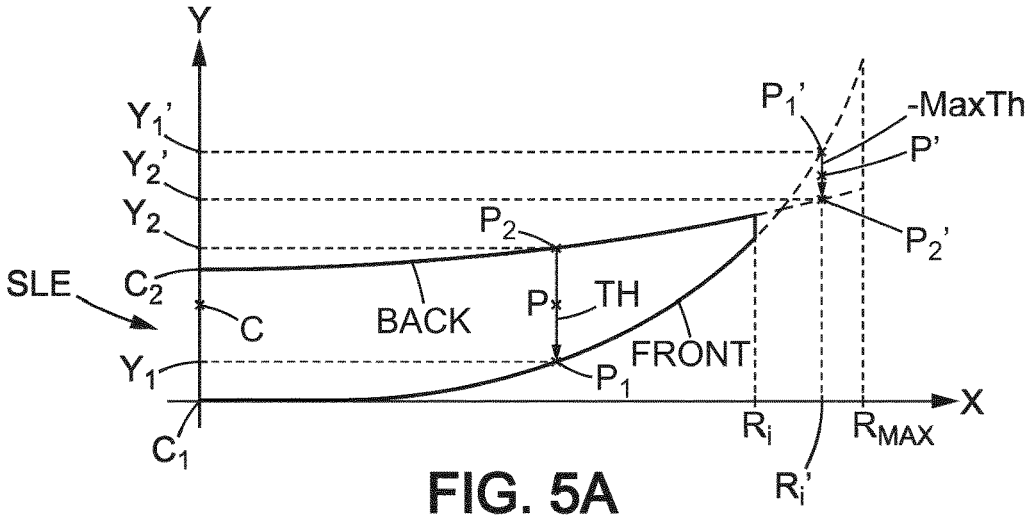
FIGS. 5A and 5B illustrate a step of determining a support material cut-related maximum diameter.

FIG. 5A illustrates a cross-sectional view of such a shape of the surfaced lens SLE, in a given cutting direction.

The surfaced lens SLE comprises a front surface FRONT and a back surface BACK. A reference point C of the device DEV is illustrated. For instance, the center C is the blocking center of the blocking ring RING or the blocking center of the blocker BLOC. The thickness TH at the center C of the surfaced lens SLE is the distance between the orthogonal projection $C_1$ of the center C on the front surface FRONT of the surfaced lens SLE and the orthogonal projection $C_2$ of the center C on the back surface BACK of the generated LEN. In reference to FIG. 5A, the cross-sectional view of the surfaced lens shape is located in an orthogonal coordinate system ($C_1$, X, Y). The axis X is the direction of the cross-sectional view from the center C to an edge of the surfaced lens SLE in the given direction, this direction being orthogonal to the straight line $C_1C_2$. The axis Y is the direction of the straight line $C_1C_2$.

For any other point P of the surfaced lens SLE, the thickness TH at this point P is defined as the distance between a first point $P_1$ and a second point $P_2$, $P_1$ being the point of intersection of a straight line, parallel to the straight line $C_1C_2$, passing through the point P, and of the front surface FRONT, $P_2$ being the point of intersection of a straight line, parallel to the straight line $C_1C_2$, passing through the point P and of the back surface BACK. In other words, if $Y_1$ is the ordinate of $P_1$ and $Y_2$ is the ordinate of $P_2$ in the orthogonal coordinate system ($C_1$, X, Y), the thickness TH at the point P is $Y_2$-$Y_1$, which is positive.

In a front view (not illustrated here), the edge of the surfaced lens SLE may not be circular. The surfaced lens SLE thus presents a maximum radius $R_{MAX}$. In the cross-sectional view of the surfaced lens SLE illustrated in FIG. 5A, the surfaced lens SLE presents, in the given direction, a radius $R_i$ inferior than the maximum radius $R_{MAX}$. The radius $R_i$ corresponds to the abscissa of the point which corresponds to the edge of the surfaced lens SLE in the given direction. Typically, the thickness of the surfaced lens shape at the edge is higher than 0.4 mm.

In the example illustrated in FIG. 5A, the thickness TH decreases from the center C to the edge of the surfaced lens shape. The surfaced lens shape may thus be theoretically extended following the curve respectively of the front surface FRONT and of the back surface BACK. This theoretical extension of the surfaced lens shape is represented with a dashed line, while the actual surfaced lens shape is represented with a solid line. The term "extension" here indicates that the respective curves of the front and back surfaces FRONT, BACK are in fact portions of curves corresponding in the orthogonal coordinate system ($C_1$, X, Y) respectively to a function. The extension is thus defined by the graphical representation of each function in the whole orthogonal coordinate system ($C_1$, X, Y). For instance, the curve of the front surface FRONT is the graphical representation of a first function for an abscissa comprised between $C_1$ and $R_i$. The curve of the back surface BACK is the graphical representation of a second function for an abscissa comprised between $C_1$ and $R_i$. The theoretical extension of the surfaced lens shape is thus obtained by the graphical representations of the first and second functions for the whole abscissa's axis, or X-axis. The surfaced lens shape is extended in each direction to the maximum radius $R_{MAX}$. The thickness TH as previously defined can be also calculated for any point located in the theoretical extension of the surfaced lens shape. Beyond the point where the thickness TH is equal to zero, the thickness TH becomes negative, since the extended front surface FRONT passes over the extended back surface BACK.

Regarding the value of the maximum thickness MaxTh of the support material which is allowed to be cut into during the operation of surfacing, a negative maximum thickness can be defined as −MaxTh. This value −MaxTh is reached at a point P'. $P'_1$ is the point of intersection of the straight line, parallel to the straight line $C_1C_2$, passing through the point P', and of the front surface FRONT, $P'_2$ is the point of intersection of the straight line, parallel to the straight line $C_1C_2$, passing through the point P' and of the back surface BACK. $Y'_1$ is the ordinate of $P'_1$ and $Y'_2$ is the ordinate of $P'_2$ in the orthogonal coordinate system ($C_1$, X, Y), the thickness TH at the point P' is thus $Y'_2$-$Y'_1$, which is equal to −MaxTh. A theoretical radius R' can be defined, in the given direction, as the abscissa of the point P'. $R'_i$ corresponds also to the abscissa of the points $P'_1$ and $P'_2$.

Alternatively, if the thickness TH does not decrease from the center C to the edge of the surfaced lens shape in the given direction, the surfaced lens shape is not extended in this direction. The theoretical radius $R'_i$ is defined, in the given direction, as the abscissa of the point P. In other words, the theoretical radius $R'_i$ is equal to $R_i$.

Figure 5B:
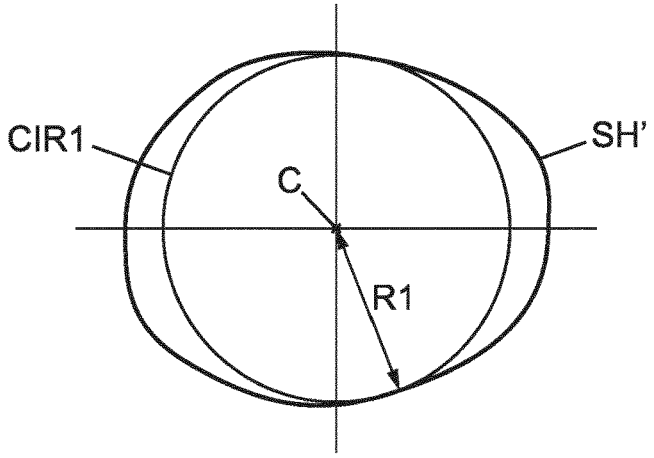

In reference now to the FIG. 5B, a theoretical shape SH' of the surfaced lens SLE is determined in the first step T1. This theoretical shape SH' corresponds to the shape of the surfaced lens SLE inside which the thickness TH is greater than −MaxTh.

As explained previously, a theoretical radius $R'_i$ in a given cutting direction is the abscissa of the point P' corresponding to the point where the thickness TH is equal to −MaxTh, if the thickness decrease from the center C to the edge of the surfaced lens shape in the given direction.

Conversely, a theoretical radius $R'_i$ in a given cutting direction is equal to $R_i$ if the thickness TH does not decrease from the center C to the edge of the surfaced lens shape in the given direction. In effect, if the thickness TH does not decrease from the center C to the edge of the surfaced lens shape, the surfaced lens shape can not be theoretically extended so that the thickness TH reaches −MaxTh since the curve of the front surface FRONT and the curve of the back surface BACK do not intersect.

The theoretical shape SH' is thus defined so that, in a given cutting direction, the corresponding radius is the theoretical radius $R'_i$ determined in the same cutting direction for the surfaced lens shape. In other words, SH' is an extension of the surfaced lens shape inside which the thickness TH is greater than −MaxTh.

In a second step T2, a support material cut-related maximum radius, also called first radius $R_1$ hereinafter, is determined to define a first circular periphery CIR1 from the theoretical shape SH' found in the previous step T1. The first radius $R_1$ of this first circular periphery CIR1 is the lowest value of $R'_i$. In other words, the first radius $R_1$ is the lowest value of abscissa, all directions considered, of the surfaced lens shape, the theoretical shape SH' included, where the thickness TH is equal to −MaxTh.

Figure 6:
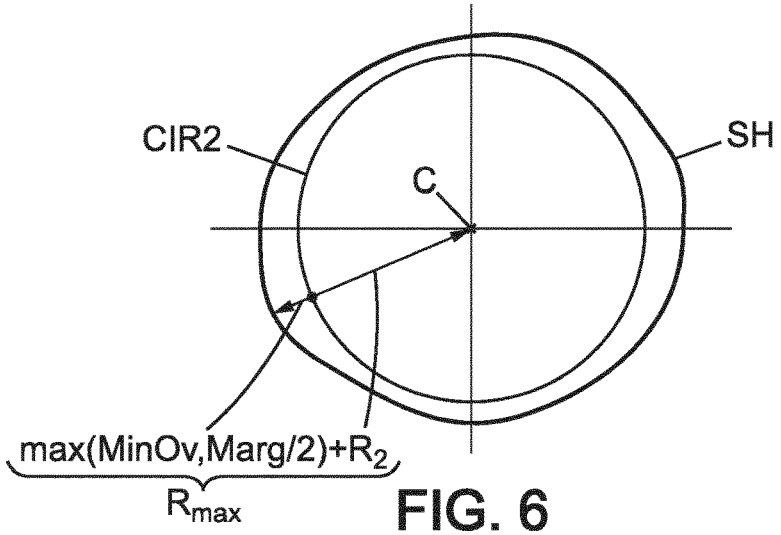
FIG. 6 illustrates a step of determining a overhang-related maximum radius.

A third step T3 is illustrated in FIG. 6.

FIG. 6 illustrates an actual shape SH of the surfaced lens SLE. In others words, the actual shape SH corresponds to the shape SH' without the theoretical extension. As explained above, such an actual shape SH may not be circular and thus presents a maximum radius $R_{MAX}$. During the third step T3, an overhang-related maximum radius, also called second radius $R_2$ hereinafter, is determined as following:

$$R_2 = R_{MAX} - \max\left(\mathrm{Min}Ov, \frac{Marg}{2}\right)$$

In the previous calculation, MinOv is the predetermined minimum overhang. In other words, MinOv is the lowest distance permitted between the edge of the surfaced lens SLE obtained after the operation of surfacing of the lens blank BLA and the edge of the circular periphery of the support material MAT. Marg is the support material tolerance margin. The second radius $R_2$ defines a second circular periphery CIR2.

In a fourth step T4, the maximum diameter $D_{MAX}$ of the support material MAT is determined as the lowest value between the double of the first radius $R_1$ and the double of the second radius $R_2$. In other words:

$$D_{MAX}=\min(2R_1,2R_2)$$

The circular periphery corresponding to the maximum diameter $D_{MAX}$ corresponds to the circular periphery having the lowest radius between the first circular periphery CIR1 and the second circular periphery CIR2.

Figure 7:
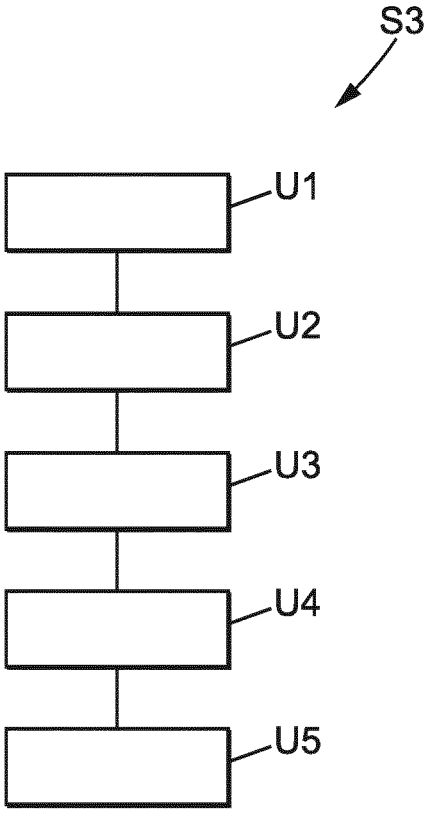
FIG. 7 illustrates schematically a method of determining a minimum diameter of the support material shape.

As for the details of step S3, FIG. 7 illustrates schematically a method of determining the minimum diameter $D_{MIN}$ of the support material shape.

In a first step U1, an overhang-related minimum radius, also called third radius $R_3$ hereinafter, is determined. This first step U1 is illustrated in FIG. 8.

Figure 8:
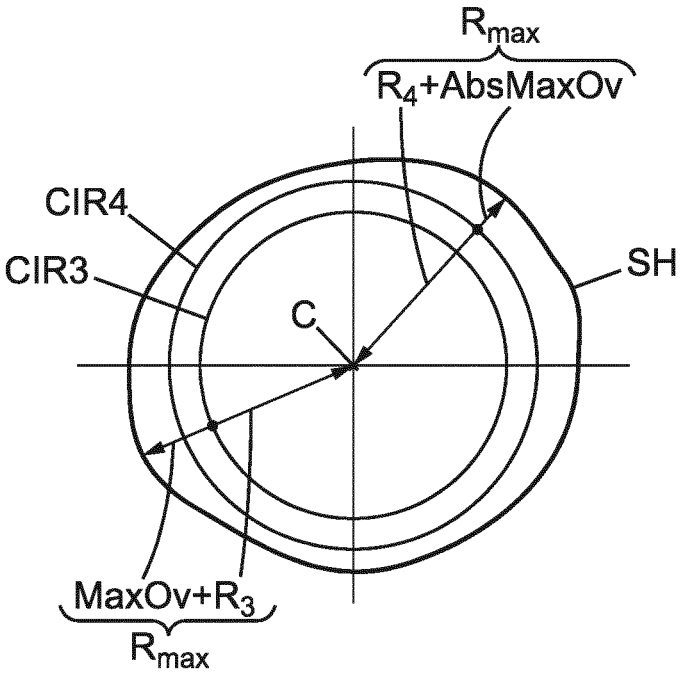
FIG. 8 illustrates a step of determining an overhang-related minimum radius and an overhang-related absolute minimum radius.

FIG. 8 illustrates the actual shape SH of the surfaced lens SLE. As explained above, such an actual shape SH may not be circular and thus presents a maximum radius $R_{MAX}$. During the first step U1, the third radius $R_3$ is determined as following:

$$R_3=R_{MAX}-\mathrm{MaxOv}$$

In the previous calculation, MaxOv is the predetermined maximum overhang. In other words, MaxOv is the greatest distance permitted between the edge of the surfaced lens SLE obtained after the operation of surfacing of the lens blank BLA and the edge of the circular periphery of the support material MAT. The third radius $R_3$ defines a third circular periphery CIR3

In a second step U2 also illustrated in FIG. 8, an overhang-related absolute minimum radius, also called fourth radius $R_4$ hereinafter, is determined as following:

$$R_4=R_{MAX}-\mathrm{AbsMaxOv}$$

In the previous calculation, AbsMaxOv is the predetermined absolute maximum overhang. The predetermined absolute maximum overhang AbsMaxOv is chosen independently from the material of the lens blank BLA. The fourth radius $R_4$ defines a fourth circular periphery CIR4. In the example illustrated in FIG. 8, the fourth radius $R_4$ is greater than the third radius $R_3$. Nevertheless, the fourth radius $R_4$ may be lower than or equal to the third radius $R_3$.

Figure 9A:
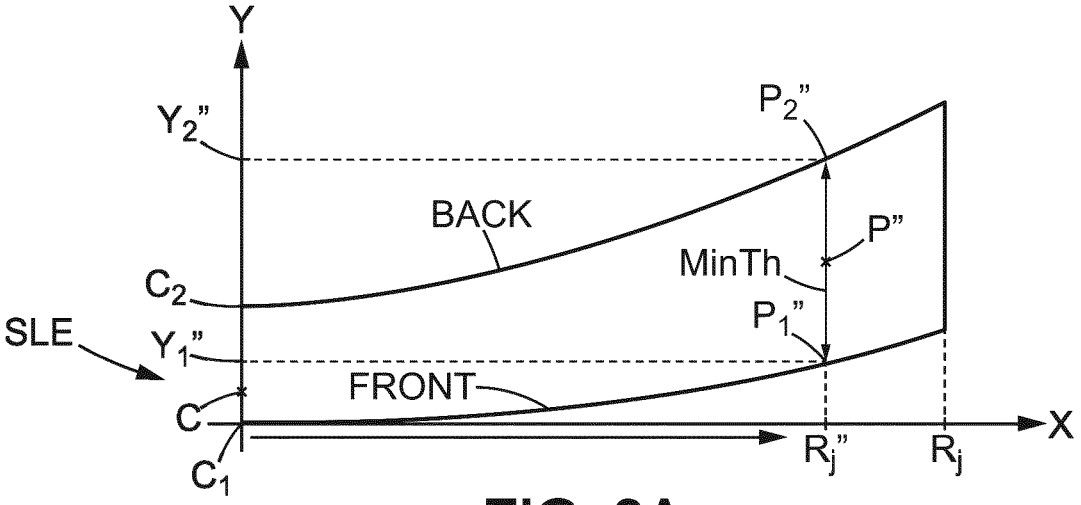
FIGS. 9A and 9B illustrate a step of determining a minimum thickness-related radius.

In a third step U3, a theoretical shape SH" of the surfaced lens SLE beyond which the thickness TH is greater than the minimum thickness MinTh is determined on the basis of the shape of the surfaced lens SLE determined in the step S1. The minimum thickness MinTh is the lowest value of thickness TH which does not need any support SUPP during the operation of surfacing. FIG. 9A illustrates a cross-sectional view of such a shape of the surfaced lens SLE, in a given cutting direction The surfaced lens shape illustrated in FIG. 9A is comparable to the surfaced lens shape illustrated in FIG. 5A. The cross-sectional view of the surfaced lens shape is located in the orthogonal coordinate system ($C_1$, X, Y). The axis X is the direction of the cross-sectional view from the center C of the surfaced lens SLE to the edge of the surfaced lens SLE in the given direction, this direction being orthogonal to the straight line $C_1C_2$. The axis Y is the direction of the straight line $C_1C_2$.

As explained above, the edge of the surfaced lens SLE may not be circular. In the cross-sectional view of the surfaced lens SLE illustrated in FIG. 9A, the surfaced lens SLE presents, in the given direction, a radius $R_j$. The radius $R_j$ corresponds to the abscissa of the edge of the surfaced lens SLE in the given direction.

The thickness TH at a point P" is defined as the distance between a first point $P''_1$ and a second point $P''_2$, $P''_1$ being the point of intersection of a straight line, parallel to the straight line $C_1C_2$, passing through the point P", and of the front surface FRONT, $P''_2$ being the point of intersection of a straight line, parallel to the straight line $C_1C_2$, passing through the point P" and of the back surface BACK. Here, $Y''_1$ is the ordinate of $P''_1$ and $Y''_2$ is the ordinate of $P''_2$ in the orthogonal coordinate system ($C_1$, X, Y). The thickness TH at the point P" is thus $Y''_2$-$Y''_1$.

In the example illustrated in FIG. 9A, the thickness TH increases from the center C to the edge of the surfaced lens shape. The thickness TH at the point P" is the minimum thickness MinTh, the abscissa $R''_j$ of the point P" is the limit beyond which the thickness TH of the surfaced lens SLE is greater than the minimum thickness MinTh. In other words, the part of the surfaced lens SLE beyond of the radius $R''_j$ does not need any support SUPP during the operation of surfacing in the given direction.

However, it is possible that the surfaced lens shape increases in another cutting direction from the center C to the edge. In such a case, there is no point beyond which the thickness TH of the surfaced lens SLE is greater than the minimum thickness MinTh, since the thickness TH decreases from the center C to the edge. In this cutting direction, the default point P" is located on the edge of the surfaced lens shape and the radius $R''_j$ is thus equal to $R_j$.

Figure 9B:
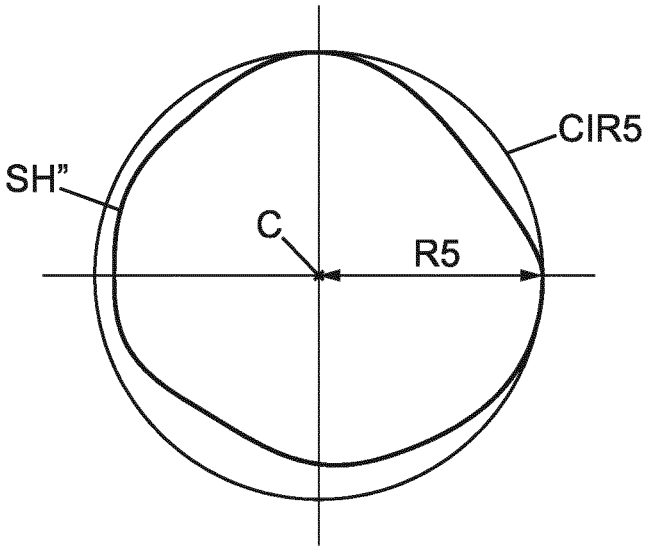

In reference now to the FIG. 9B, a theoretical shape SH" of the surfaced lens SLE is determined. This theoretical shape SH" corresponds to the shape of the surfaced lens SLE beyond which the thickness TH is greater than MinTh. In other words, the theoretical shape SH" of the surfaced lens SLE is the shape beyond which no support SUPP is needed during the operation of surfacing.

In a fourth step U4, a minimum lens thickness-related radius, also called fifth radius $R_5$ hereinafter, is determined to define a fifth circular periphery CIR5 from the theoretical shape SH" found in the previous step U3. The fifth radius $R_5$ of this fifth circular periphery CIR5 is the greatest value of $R''_j$. In other words, the fifth radius $R_5$ is the greatest value of abscissa, all directions considered, of the surfaced lens shape beyond which no support is needed during the operation of surfacing.

In a fifth step U5, the minimum diameter $D_{MIN}$ of the support material MAT is determined as the lowest value between the double of the third radius $R_3$ on the one hand, and, on the other hand, the greatest value between the double of the fourth radius $R_4$ and the double of the fifth radius $R_5$. In other words:

$$D_{MIN}=\min(2R_3,\max(2R_4,2R_5))$$

The circular periphery corresponding to the minimum diameter $D_{MIN}$ corresponds to the circular periphery having the lowest radius between the third circular periphery CIR2 on the one hand, and, on the other hand, the circular periphery having the greatest radius between the fourth circular periphery CIR4 and the fifth circular periphery CIR5.

As explained above, the diameter D of the circular periphery of the support material MAT is chosen between the minimum diameter $D_{MIN}$ and the maximum diameter $D_{MAX}$ for the further operation of surfacing per se. The choice of minimizing or maximizing the diameter D of the support material MAT may form part of the configuration data. For instance, the choice of minimizing the diameter D of the support material MAT makes it possible to reduce the size of the support SUPP and thus to minimize the duration of the blocking step. Such a choice may also be justified by the reduction in support material MAT consumption. Conversely, the choice of maximizing the diameter D of the support material MAT makes it possible to increase the adhesion force between the lens blank BLA and the support SUPP. Such a choice reduces the risk of a "deblocking" in the following steps, in the generator GEN for instance. In addition, maximizing the diameter D of the support material MAT secures the edge of the lens, especially in the case of thin lenses.

The invention has several advantages.

Firstly, the proposed method enables to optimize the utilization of the support material MAT during the blocking step. In particular, the proposed method enables to avoid wasting support material MAT. In effect, the support MAT cut during the operation of surfacing represent a loss but also an important risk for the environment.

In addition, the proposed method ensures a sufficient blocking of the lens blank BLA since the diameter D of the support material MAT respects conditions and constraints as the thickness TH of the surfaced lens SLE, the predetermined minimum and maximum overhang or the support material tolerance margin Marg.

The invention claimed is:

1. A method of preparing a lens blank and surfacing said lens blank, the method comprising:

determining, by a processor, a surfaced lens shape based on input data;

based on the determined surfaced lens shape, determining, by the processor, a maximum diameter of a support material shape having a circular periphery as a function of a predetermined maximum thickness defining the maximum thickness of a support material configured to define the support material shape, which is allowed to be cut into during the surfacing of the lens blank and a function of an overhang-related maximum radius determined based on a support overhang corresponding to a radial distance between an edge of the surfaced lens shape and an edge of the support material, the overhang-related maximum radius being determined based on the maximum radius of the surfaced lens shape, a predetermined minimum support overhang, and a support material tolerance margin related to a precision with which the support material is formed;

choosing, by the processor, a diameter for the support material shape less than or equal to said determined maximum diameter;

preparing a support that includes a support base and the support material via which the lens blank is to be fastened to the support base, the support material defining the determined support material shape having a diameter corresponding to the chosen diameter;

fastening the lens blank to the prepared support via the support material; and surfacing the lens with a generator, the surfacing transforming the lens blank into a surfaced lens having the determined surfaced lens shape at the end thereof.

2. The method of claim 1, wherein a minimal distance from the center of the support material at which, beyond an edge of the surfaced lens shape, the thickness of the surfaced lens shape is equal, in absolute value, to the maximum thickness is determined, said minimal distance defining a support material cut-related maximum radius of the support material shape based on which the maximum diameter of the support material shape is determined.

3. The method of claim 1, wherein the minimal distance from the center of the support material at which, beyond an edge of the surfaced lens shape, the thickness of the surfaced lens shape is equal, in absolute value, to the maximum thickness is determined, said minimal distance defining a support material cut-related maximum radius of the support material shape based on which the maximum diameter of the support material shape is determined, and wherein the maximum diameter is chosen as the minimum between double the overhang-related maximum radius and double the support material cut-related maximum radius.

4. The method of claim 1, further comprising determining a minimum diameter of said support material shape, and wherein the diameter for the support material shape is chosen to be equal or greater than the minimum diameter.

5. The method of claim 4, wherein the minimum diameter is determined as a function of an overhang-related minimum radius determined based on the support overhang.

6. The method according to claim 5, wherein the overhang-related minimum radius is determined as a function of the maximum radius of the surfaced lens shape and a predetermined maximum overhang which is chosen as a function of the material of the lens blank.

7. The method of claim 4, wherein the minimum diameter is determined as a function of an overhang-related absolute minimum radius defined as a function of the maximum radius of the surfaced lens shape and a predetermined absolute maximum overhang chosen for the surfacing of the lens blank independently from the material of the lens blank.

8. The method of claim 4, wherein the minimum diameter is determined as a function of a minimum lens thickness-related radius determined based on a chosen minimum thickness of the surfaced lens shape.

9. The method of claim 8, wherein the minimum lens thickness-related radius is determined as the radius which the of the region of the lens outside of thickness of the surfaced lens shape is above the chosen minimum thickness.

10. The method according to claim 8, wherein the minimum diameter is determined as a function of an overhang-related minimum radius determined based on the support overhang, wherein the minimum diameter is determined as a function of an overhang-related absolute minimum radius defined as a function of the maximum radius of the surfaced lens shape and a predetermined absolute maximum overhang chosen for the surfacing of the lens blank independently from the material of the lens blank, and wherein the minimum diameter of said support material shape is determined as corresponding to the minimum between the overhang-related minimum radius, and the maximum of the overhang-related absolute minimum radius and the minimum lens thickness-related radius.

11. The method of claim 1, wherein choosing the diameter of the support material shape is carried out based on configuration data representative at least of predetermined preference settings for the surfacing.

12. The method of claim 2, further comprising determining a minimum diameter of said support material shape, and wherein the diameter for the support material shape is chosen to be equal or greater than the minimum diameter.

13. The method of claim 3, further comprising determining a minimum diameter of said support material shape, and wherein the diameter for the support material shape is chosen to be equal or greater than the minimum diameter.

14. The method of claim 5, wherein the minimum diameter is determined as a function of an overhang-related absolute minimum radius defined as a function of the maximum radius of the surfaced shape and a predetermined absolute maximum overhang chosen for the surfacing of the lens blank independently from the material of the lens blank.

15. The method of claim 6, wherein the minimum diameter is determined as a function of an overhang-related absolute minimum radius defined as a function of the maximum radius of the surfaced lens shape and a predetermined absolute maximum overhang chosen for the surfacing of the lens blank independently from the material of the lens blank.

16. A system for preparing a lens blank and surfacing said lens blank, the system comprising:

a processor configured to:

determine a surfaced lens shape based on input data, determine, based on the determined surfaced lens shape, a maximum diameter of a support material shape having a circular periphery as a function of a predetermined maximum thickness defining the maximum thickness of a support material configured to define the support material shape, which is allowed to be cut into during the surfacing of the lens blank and a function of an overhang-related maximum radius determined based on a support overhang corresponding to a radial distance between an edge of the surfaced lens shape and an edge of the support material, the overhang-related maximum radius being determined based on the maximum radius of the surfaced lens shape, a predetermined minimum support overhang, and a support material tolerance margin related to a precision with which the support material is formed, and choose a diameter for the support material shape less than or equal to said determined maximum diameter;

a support that includes a support base and the support material via which the lens blank is to be fastened to the support base, the support material defining the determined support material shape having a diameter corresponding to the chosen diameter, the lens blank being fastened to the prepared support via the support material; and a generator configured to surface the lens by transforming the lens blank into a surfaced lens having the determined surfaced lens shape at the end thereof.

* * * * *